US007325843B2

(12) United States Patent
Coleman et al.

(10) Patent No.: US 7,325,843 B2
(45) Date of Patent: Feb. 5, 2008

(54) LATCH MECHANISM

(75) Inventors: Peter Coleman, Birmingham (GB); Gurbinder Kalsi, Oldbury (GB)

(73) Assignee: ArvinMeritor Light Vehicle Systems (UK) Limited, West Midlands (GB)

( * ) Notice: Subject to any disclaimer, the term of this patent is extended or adjusted under 35 U.S.C. 154(b) by 149 days.

(21) Appl. No.: 10/917,251

(22) Filed: Aug. 12, 2004

(65) Prior Publication Data

US 2005/0035604 A1 Feb. 17, 2005

(30) Foreign Application Priority Data

Aug. 13, 2003 (GB) ..... 0319030.3

(51) Int. Cl.
*E05C 3/06* (2006.01)
*E05C 3/00* (2006.01)

(52) U.S. Cl. ..... 292/216; 292/201; 292/DIG. 23

(58) Field of Classification Search ..... 292/201, 292/216, DIG. 23
See application file for complete search history.

(56) References Cited

U.S. PATENT DOCUMENTS 5,454,608 A * 10/1995 Dzurko et al. ..... 292/216
5,632,515 A 5/1997 Dowling
5,803,515 A * 9/1998 Arabia et al. ..... 292/216
6,540,271 B1 * 4/2003 Kalsi ..... 292/216
6,601,883 B1 * 8/2003 Kalsi ..... 292/216
6,883,839 B2 * 4/2005 Belmond et al. ..... 292/201

FOREIGN PATENT DOCUMENTS

| | | |
|---|---|---|
| EP | 0828049 | 3/1998 |
| WO | 0011290 | 3/2000 |
| WO | WO 00/11290 | 3/2000 |

OTHER PUBLICATIONS

Search Report under Sec. 17, Feb. 10, 2004.
European Search Report dated Feb. 14, 2007.

* cited by examiner

*Primary Examiner*—Carlos Lugo
(74) *Attorney, Agent, or Firm*—Carlson, Gaskey & Olds

(57) ABSTRACT

A latch mechanism for a vehicle door includes a latch bolt, a pawl biased into engagement with the latch bolt to maintain the latch bolt in a latched condition, and a manual release lever for operable linkage to a vehicle door handle. A power release member is movable to displace the pawl from an engaged position where the pawl engages the latch bolt to a disengaged position where the pawl does not engage the latch bolt. A clutch member is mounted such that movement of the pawl causes movement of the clutch member. The clutch member is movable by the manual release lever between a first rest position at which a break is created in a transmission path from the power release member to the pawl and a second position at which power actuation of the power release member moves the pawl from the engaged position to the disengaged position.

17 Claims, 9 Drawing Sheets

LATCH MECHANISM

REFERENCE TO RELATED APPLICATION

This patent application claims priority to Great Britain Patent Application No. GB 0319030.3 filed on Aug. 13, 2003.

TECHNICAL FIELD

This invention relates to a latch mechanism for a vehicle door, particularly, but not exclusively, for light passenger and goods vehicles.

BACKGROUND OF THE INVENTION

Powered locking/unlocking and powered latching/unlatching of doors is becoming more favored, both as part of a central locking system and to enable more effective weathersealing of doors and greater freedom in styling and design. Power actuated unlatching of doors provides advantages. For one, many of the mechanical linkages and components needed for conventional manual inside and outside door handles can be dispensed with. Additionally, unitary lock and latch modules of standard form can be provided which can be quickly installed in doors of a wide range of vehicle models and types without special adaptation.

An example of power unlatching is described and claimed in PCT Publication No. WO00/11290 (Meritor). This document discloses an overriding element that interacts with a manual release lever to engage a drive connection from a power release actuator when the manual release lever is actuated and disengage the drive connection when the manual release lever is not actuated.

The present invention seeks to overcome, or at least mitigate, the problems of the prior art, in particular to provide a more compact and cost effective latch mechanism.

SUMMARY OF THE INVENTION

A latch includes a pivotal latch claw having a mouth that co-acts with a striker operatively mounted to an associated door post. A pawl tooth of a latching pawl self-engages with a first safety abutment of the latch claw to retain the latch claw releasably at a first safety position at which a door is near closed. The pawl tooth of the latching pawl self-engages with a second safety abutment of the latch claw to retain the latch claw at an inner position at which the door is fully shut. A pawl lifter engages the latch pawl to disengage the latch pawl from the latch claw to open the door.

A manual release lever is operatively connected to a door handle by a mechanical linkage. A lug of the manual release lever provides a lost-motion connection between the manual release lever and the pawl lifter such that rotation of the manual release lever rotates the pawl lifter. The manual release lever includes a lug that is received within a window of a clutch lever and provides a lost motion connection between the manual release lever and the clutch lever.

The latch also includes a power release lever. An electric motor drives the power release lever from a rest position to an actuated position in response to a signal from a controller.

When the latch is unlocked, a vehicle user actuates the door handle to rotate the manual release lever. The clutch lever rotates until the clutch lever abuts the stop. Once the door handle has been pulled a predetermined amount, a "high" signal is sent to the controller, and the controller signals the electric motor to drive and pivot the power release lever. The pawl tooth disengages from the latch claw, and the latch claw is now free to rotate to release the striker and enable the user to open the door. When the door handle is no longer actuated and power actuation has ceased, the power release lever, the manual release lever, and the clutch lever return to their rest positions.

These and other features of the present invention will be best understood from the following specification and drawings.

BRIEF DESCRIPTION OF THE DRAWINGS

An example of the invention is now more particularly described with reference to the accompanying drawings in which.

DETAILED DESCRIPTION OF THE PREFERRED EMBODIMENT

Figure 1:
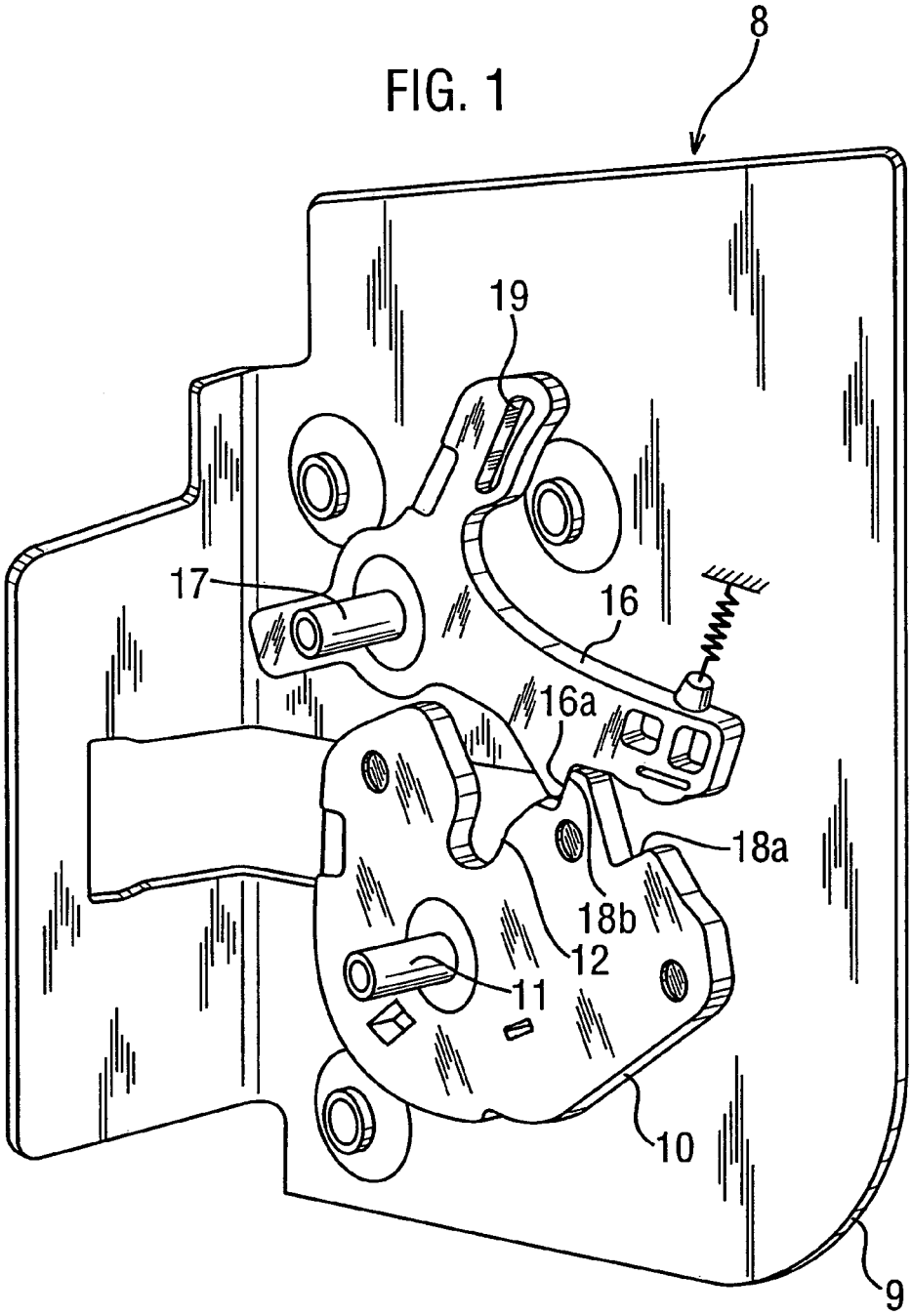
FIG. 1 is a perspective view of a vehicle door latch in a partially assembled state.

FIG. 1 illustrates a latch 8, which will be operatively secured in a door (not shown) in a known manner. The latch 8 includes a conventional latch bolt in the form of a rotating latch claw 10 having a mouth 12 for co-acting with a striker (not shown) operatively mounted to an associated door post. The latch claw 10 is pivotally mounted to a retention plate 9 of the latch 8 via a claw pin 11 and is biased by a claw spring (not shown) in a counter-clockwise direction. A pawl tooth 16*a* of a latching pawl 16 self-engages with a first safety abutment 18*a* of the latch claw 10 in a known manner to releasably retain the latch claw 10, and hence the door, at a first safety position at which the door is near closed. The pawl tooth 16*a* of the latching pawl 16 self-engages with a second safety abutment 18*b* of the latch claw 10 to retain the latch claw 10 at an inner position at which the door is fully shut. The latching pawl 16 is pivotally mounted to the retention plate 9 via a pawl pin 17 and further includes a slot 19 for engagement by a pawl lifter 20 (shown in FIGS. 2 and 3).

Figure 2:
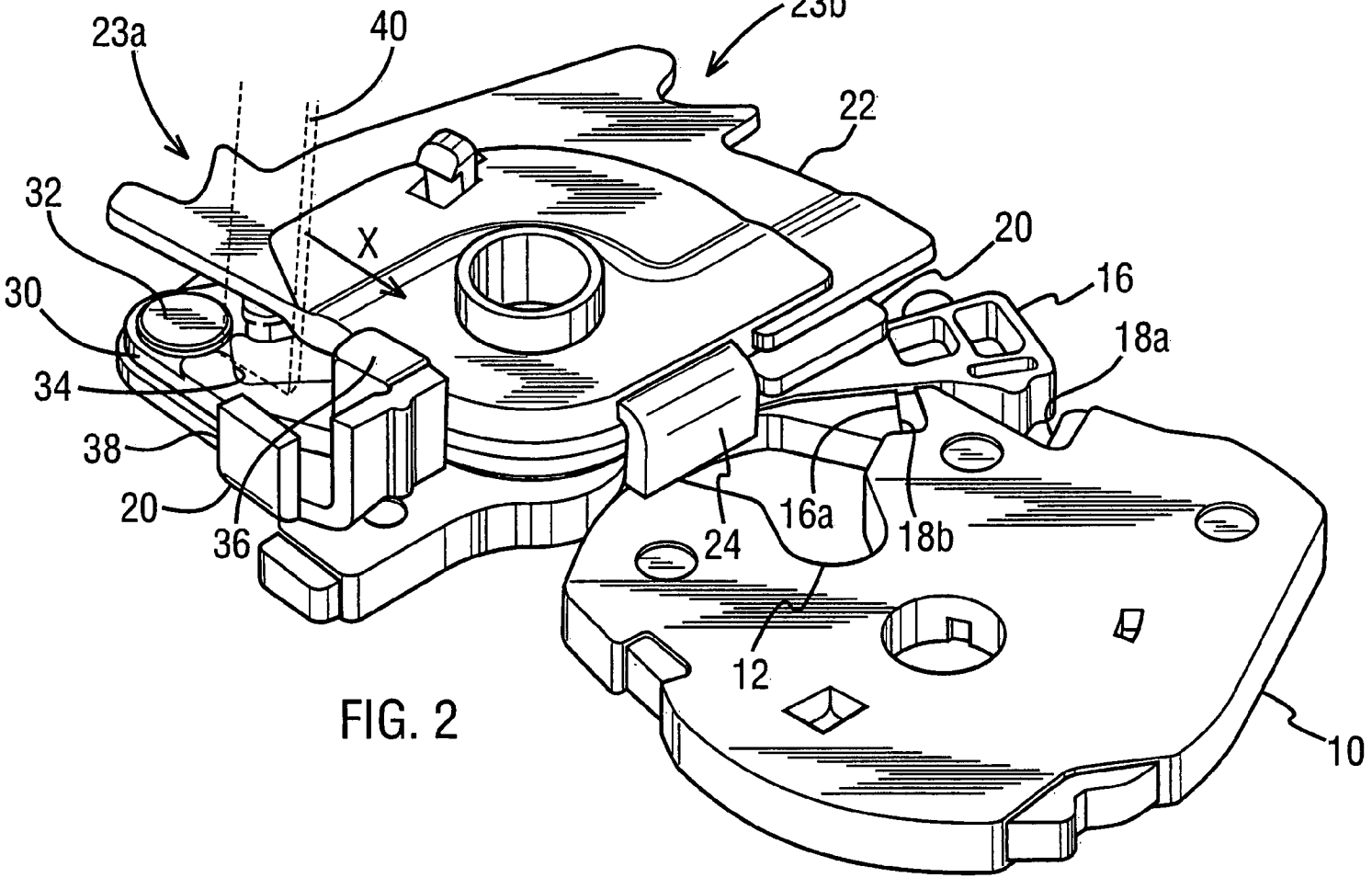
FIG. 2 is a perspective view of parts of the vehicle door latch according to one embodiment of the present invention in a rest position with some parts not relevant to the invention removed for clarity.
Figure 3:
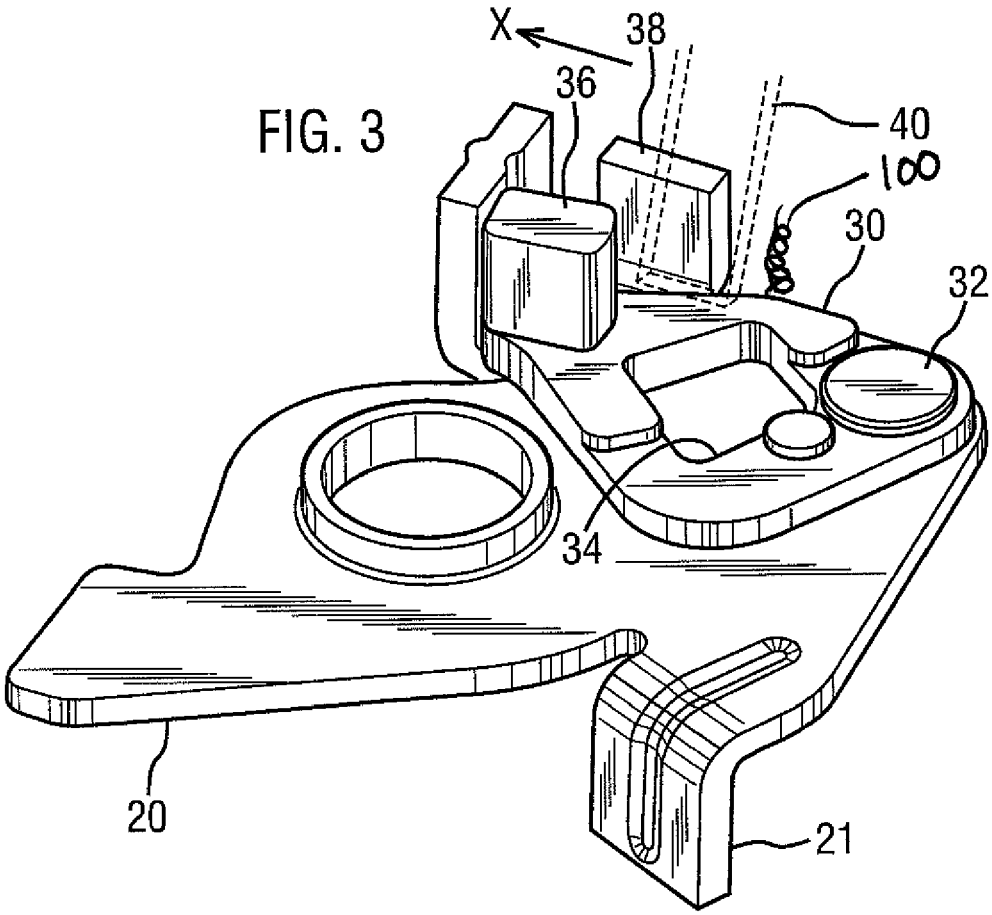
FIG. 3 is a perspective view of a pawl lifter of the vehicle door latch of FIG. 2.
Figure 4:
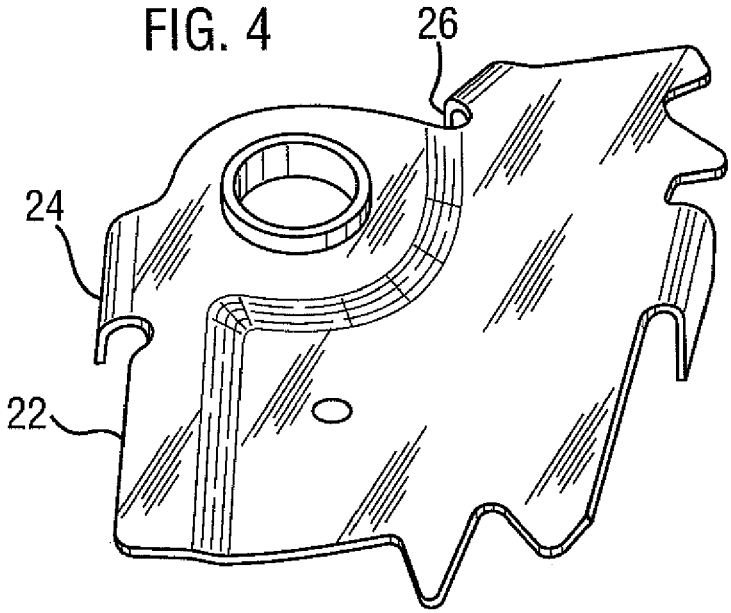
FIG. 4 is a perspective view of a manual release lever of the vehicle door latch of FIG. 2.

Referring to FIGS. 2 to 4, an unlatching mechanism of a latch mechanism of the latch 8 includes the pawl lifter 20 in the form of a lever pivoted co-axially with, and on top of, the latching pawl 16 on the pawl pin 17. The pawl lifter 20 includes a lug 21 that engages the slot 19 of the latching pawl 16. When the pawl lifter 20 is angularly displaced counter-clockwise from the rest position shown in FIG. 1, the pawl lifter 20 causes disengagement of the latching pawl 16 from the latch claw 10 to allow the door to open.

A clutch member in the form of a clutch lever 30 is pivotally mounted to the pawl lifter 20 by a pin 32 that is offset from the pawl pin 17 and resiliently biased in a clockwise direction relative to the pawl lifter 20 by a clutch lever spring 100. The clutch lever 30 includes a window 34 and a projection 36 that extends away from the pawl lifter 20. A stop 38 formed from the pawl lifter 20 limits clockwise rotation of the clutch lever 30.

A manually operable release mechanism of the assembly includes a manual release lever 22, best seen in FIG. 4, operatively connected to an inside door handle 48 and an outside door handle 50 (shown schematically) via a mechanical linkage including inside and outside release levers (not shown) configured to engage lug formations 23*a* and 23*b*, respectively, on the manual release lever 22. The manual release lever 22 is pivotally mounted on the pawl pin 17 co-axially, but independently of the pawl lifter 20, overlying the pawl lifter 20 as viewed in FIG. 2. A further lug 24 of the manual release lever 22 provides a lost-motion connection between the manual release lever 22 and the pawl lifter 20 such that the pawl lifter 20 is rotated by counter-clockwise rotation of the manual release lever 22. A torsion spring (not visible) biases the manual release lever 22 in a clockwise direction relative to the pawl lifter 20.

Counter-clockwise rotation of the clutch lever 30 is limited by the manual release lever 22. The manual release lever 22 includes a further lug 26 (shown in FIG. 4) that is received within the window 34 of the clutch lever 30 and provides a lost motion connection between the manual release lever 22 and the clutch lever 30. In the rest position (shown in FIGS. 2 and 5), the further lug 26 substantially holds the clutch lever 30 at its counter-clockwise limit of rotation, overcoming the force of the clutch lever spring and providing a gap between the projection 36 and the stop 38

Figure 5:
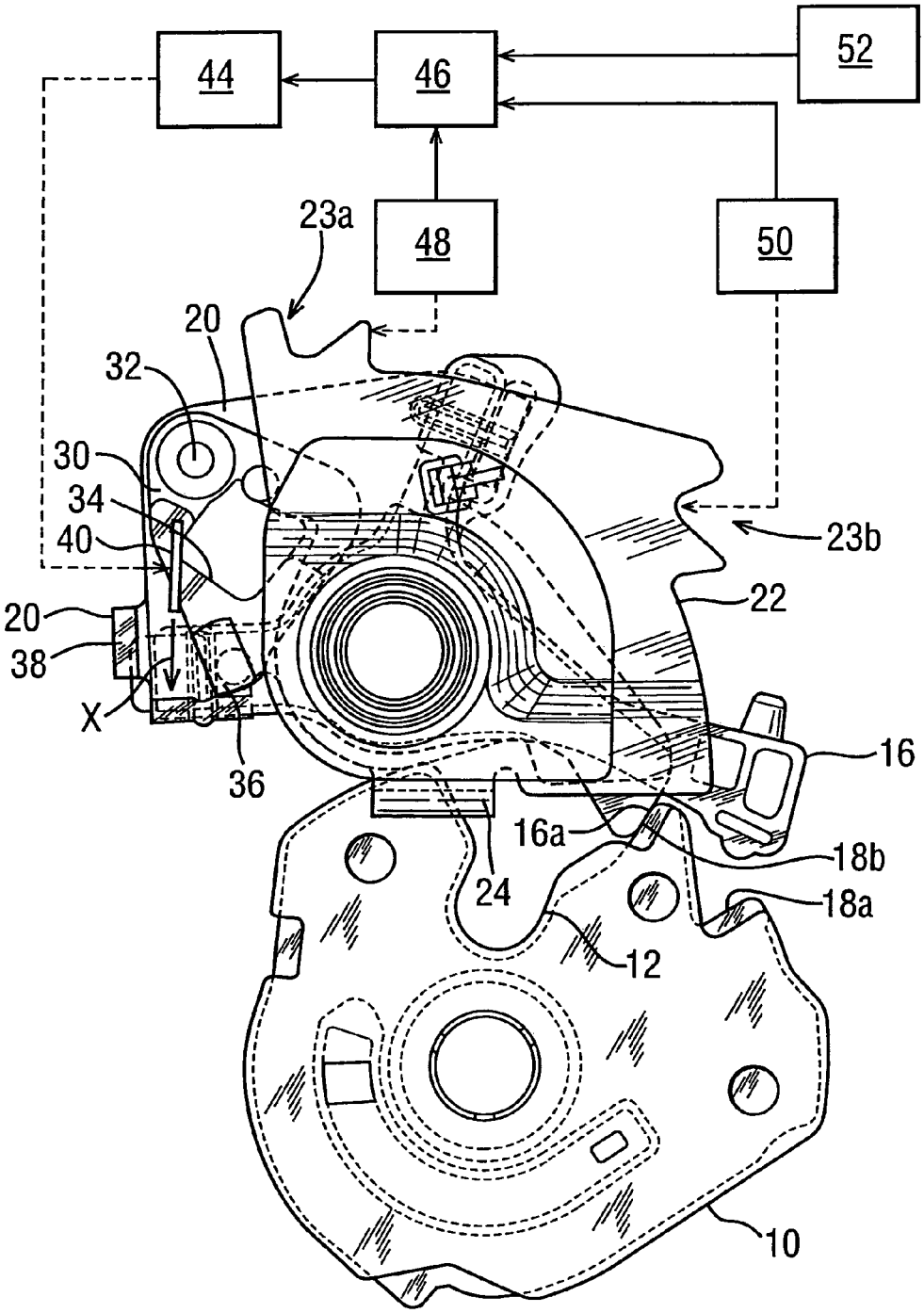
FIG. 5 is a plan view of the latch of FIG. 2 in a rest position.
Figure 7:
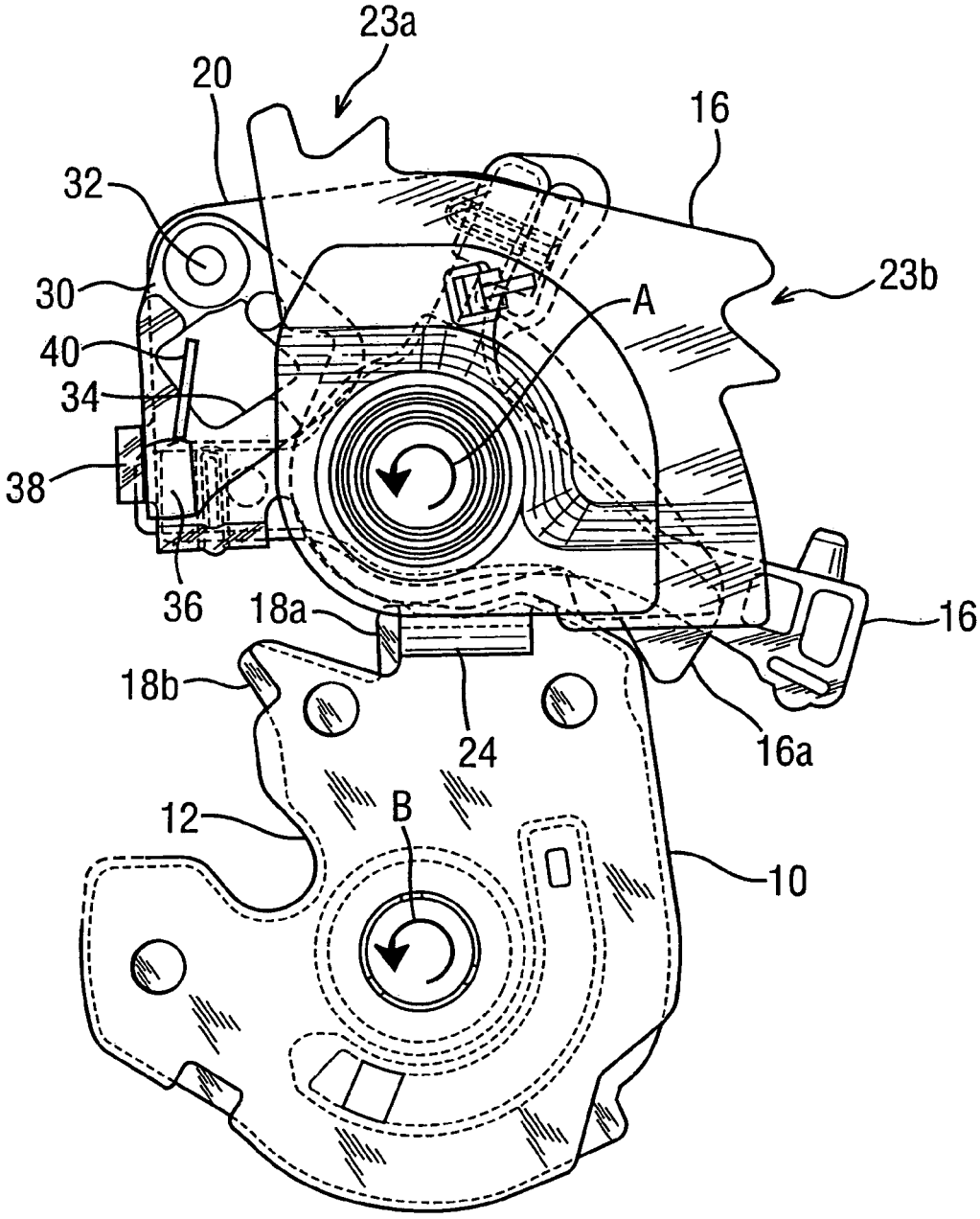
FIG. 7 is a plan view of the vehicle door latch of FIG. 2 in a released position.

A power release member in the form of a power release lever 40 (shown in broken lines in FIGS. 2 and 3 and in solid cross-section in FIGS. 5 and 7) is fulcrummed on a fixed pivot whose axis is at a right angle relative to the claw pin 11 and the pawl pin 17. FIGS. 2, 3 and 5 show the power release lever 40 in a rest position, and FIG. 7 shows the power release lever 40 in an actuated position.

Referring to FIG. 5, the schematic portion shows signal paths as solid lines and mechanical connections as broken lines. A power actuator (which includes only actuators whose power source is the vehicle to which the latch is fitted, as opposed to vehicle users or other external power sources), such as an electric motor 44 (illustrated schematically), is capable of driving the power release lever 40 in a direction X from the rest position to the actuated position in response to a signal from a controller 46. The controller 46 receives electrical inputs from the inside door handle 48 and the outside door handle 50 and a locking mechanism 52. The controller 46 is capable of determining whether to signal the driving of the electric motor 44 on the basis of its inputs and its internal logic in a known way (e.g., if the locking mechanism is superlocked, then the controller will not signal the driving of the motor irrespective of the inputs from either the inside door handle 48 or the outside door handle 50). The locking mechanism may also provide a suitable break or block in the mechanical connection between the inside door handle 48 and/or the outside door handle 50 and the power release lever 40, depending upon the locked state of the latch 8, as is known in the art.

Figure 6:
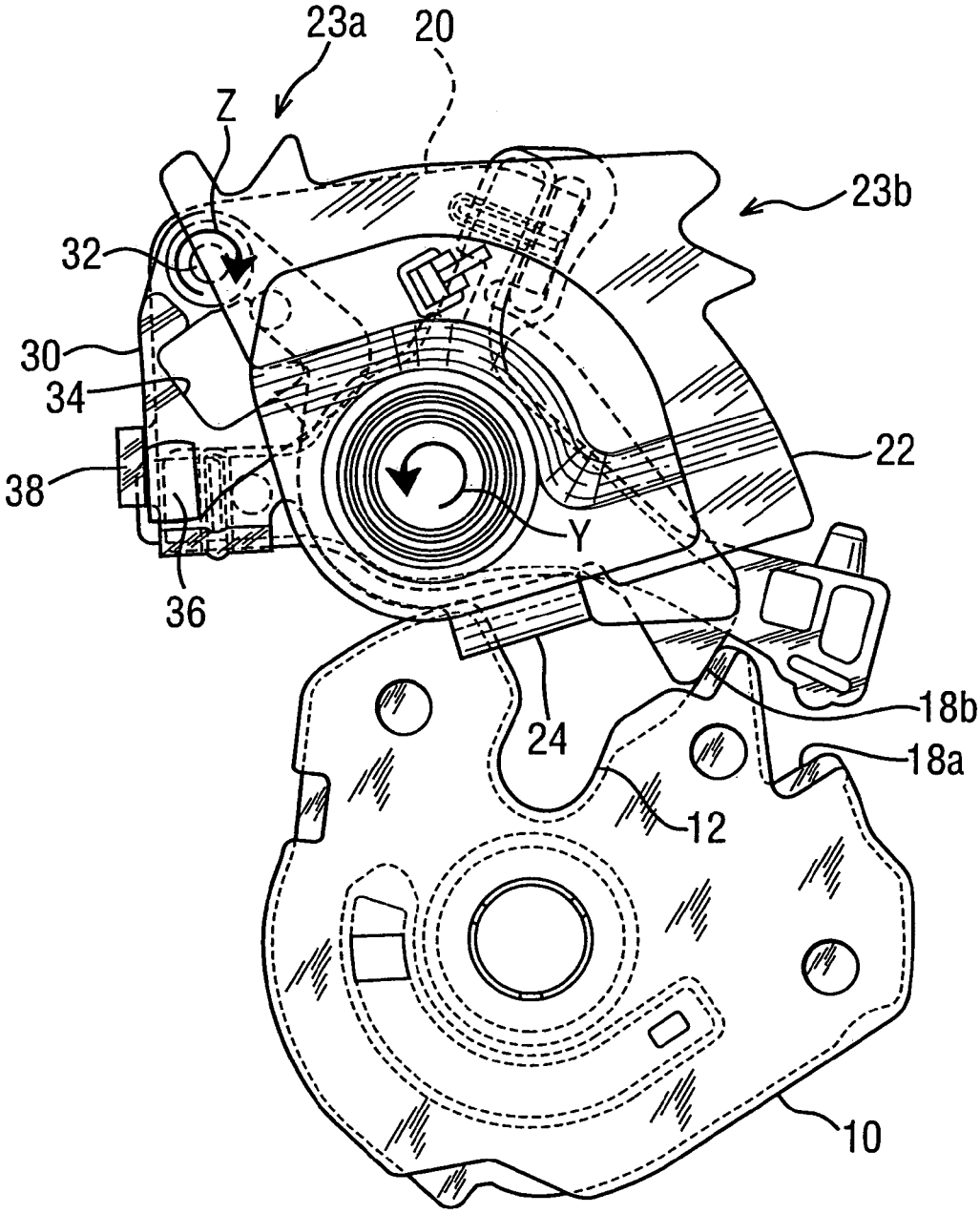
FIG. 6 is a plan view of the vehicle door latch of FIG. 2 in a clutch engaged position.

Operation of the mechanism is as follows. Starting from the rest condition shown in FIGS. 2 and 5 with the latch 8 unlocked, a vehicle user actuates either the inside door handle 48 or the outside door handle 50, causing the manual release lever 22 to rotate counter-clockwise as indicated by arrow Y of FIG. 6. The resilient biasing connection between the manual release lever 22 urges the clutch lever 30 clockwise as indicated by arrow Z until the clutch lever 30 abuts the stop 38, as shown in FIG. 6. Once the inside door handle 48 or the outside door handle 50 has been pulled a predetermined amount, a "high" signal is sent to the controller 46. Since the locking mechanism 52 indicates that the latch 8 is unlocked, the controller 46 signals the electric motor 44 to drive and pivot the power release lever 40 in direction X. The timing of this actuation is controlled to ensure that the clutch lever 30 has already pivoted clockwise. As a result, the power release lever 40 abuts the projection 36, forcing the pawl lifter 20 and the latching pawl 16 to rotate counter-clockwise, as indicated by arrow A of FIG. 7. Consequently, the pawl tooth 16*a* disengages from the latch claw 10. The latch claw 10 is now free to rotate counter-clockwise, as indicated by arrow B, to release the striker and thereby enable the user to open the door.

With the inside door handle 48 and the outside door handle 50 no longer actuated and power actuation ceasing, the power release lever 40, the manual release lever 22, and the clutch lever 30 will return to their rest positions shown in FIGS. 2 and 5. The rest condition declutches the power actuator drive, and the power release lever 40 cannot block or impede subsequent closing and relatching of the door.

The latch 8 may also be manually unlatched as a safety backup system if power unlatching fails. For manual unlatching to occur, the user must pull further on the inside door handle 48 or the outside door handle 50 than is required for power unlatching so that the manual release lever 22 is rotated to a point beyond that at which the further lug 24 abuts the pawl lifter 20 so that the pawl tooth 16*a* is manually lifted clear of the latch claw 10. The door can thus still be opened and closed in the normal way even if power actuation should fail, for example due a flat battery. The mechanism is reset when the door is reclosed. In other embodiments, manual release may be achieved by a two-pull process.

Figure 8:
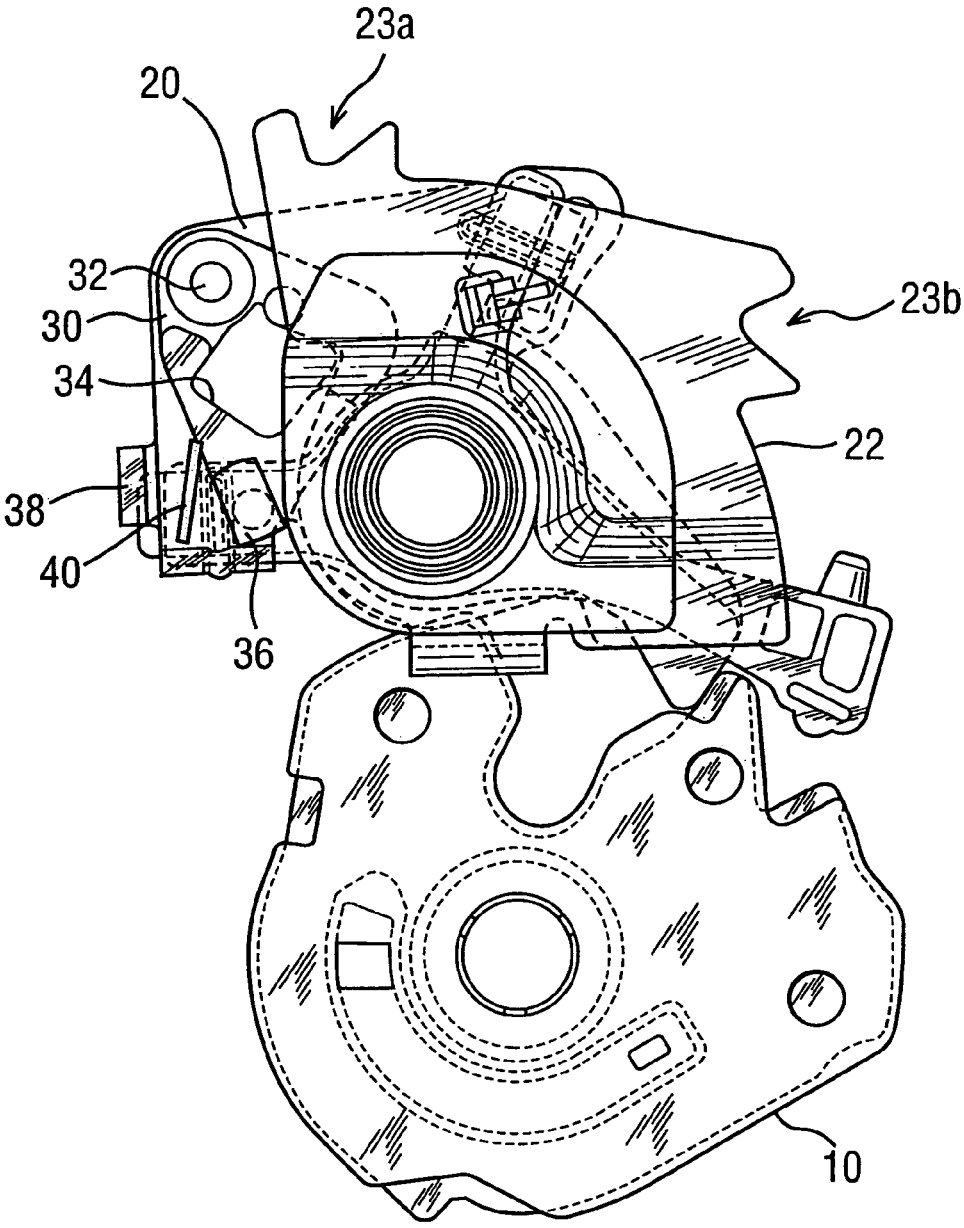
FIG. 8 is a plan view of the vehicle door latch of FIG. 2 in a clutch position.

Referring now to FIG. 8, if the power release lever 40 is actuated without the inside door handle 48 or the outside door handle 50 having been pulled (e.g., due a short circuit or motor malfunction), the projection 36 of the clutch lever 30 is not in the clockwise position of FIG. 6. The power release lever 40 therefore does not contact the projection 36 and moves to the full extent of its travel without rotating the pawl lifter 20 (i.e., it cannot move any further down than the position shown in FIG. 8 to rotate the pawl lifter 20). In this condition, power unlatching cannot occur. This is an important safety feature because any malfunctioning of the actuator or its power supply and control circuitry, e.g., due to a short circuit or ingress of moisture causing the actuator to run uncommanded, will not be transmitted to the pawl lifter 20. Inadvertent power unlatching, particularly while the vehicle was in motion and possibly at high speed, could be very dangerous.

FIGS. 9 to 12 illustrate a second embodiment of the present invention. Like parts are, where possible, indicated by the same numerals as for the first embodiment, but with the prefix "1". Only those differences with respect to the first embodiment are discussed in more detail below.

Figure 9:
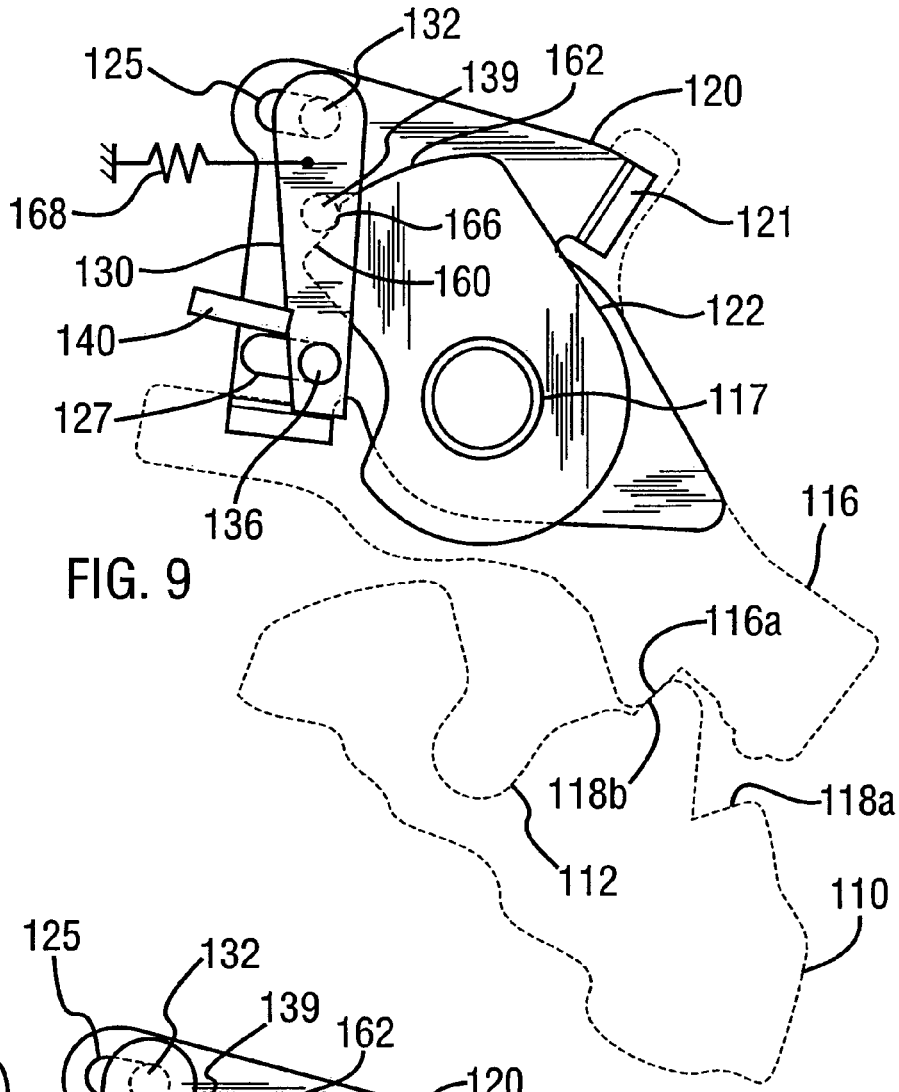
FIG. 9 is a plan view of a vehicle door latch according to a second embodiment of the present invention in a rest position.

With reference to FIG. 9, the pawl 116 and the claw 110 (shown in broken lines) are substantially the same as those of the first embodiment, and the pawl lifter 120 is pivotally mounted co-axially with the pawl 116. A simplified representation of the manual release lever 122 is co-axially mounted with the pawl lifter 120, and a lost motion connection allows limited relative motion between the manual release lever 122 and the pawl lifter 120.

An elongate clutch lever 130 is positioned on top of (i.e., extending further out of the plane of FIG. 9 than) the pawl lifter 120 and the manual release lever 122. A first projection 132 and a second projection 136 are provided proximate to each end of the elongate clutch lever 130. The first projection 132 extends into the plane of FIG. 9 and is located in a first slot 125 in the pawl lifter 120. The second projection 136 extends both into and out of the plane of FIG. 9 when viewed in FIG. 9. The portion extending into the paper is located in a second slot 127 in the pawl lifter 120. The portion extending out of the plane of FIG. 9 may be abutted by the power release lever 140. The first slot 125 and the second slot 127 are substantially parallel.

A cam follower 139 extends into the paper between the first projection 132 and the second projection 136 and is arranged to contact a peripheral cam surface of the manual release lever 122 having a relatively small constant radius portion 160 and a relatively large constant radius portion 162. A ramp portion 166 is between the relatively small constant radius portion 160 and the relatively large constant radius portion 162.

A spring 168 acting between the first projection 132 and the cam follower 139 urges the first projection 132 and the second projection 136 towards the right-hand end of the first slot 125 and the second slot 127 and urges the cam follower 139 into contact with the relatively small constant radius portion 160 and the relatively large constant radius portion 162.

Operation of the mechanism is as follows. Starting from the rest condition shown in FIG. 9, with the latch 8 unlocked, a vehicle user actuates either the inside door handle 48 or the outside door handle 50, causing the manual release lever 122 to rotate counter clockwise as indicated by arrow Y1 of FIG. 10. The cam follower 139 shifts to the left because it moves from the relatively small constant radius portion 160 to the relatively large constant radius portion 162.

Since the spring 168 is located between the first projection 132 and the cam follower 139, the resistance to the sliding of the second projection 136 in the second slot 127 is less than that the resistance to the sliding of the first projection 132 in the first slot 125. The elongate clutch lever 130 pivots clockwise as indicated by arrow Z1 to the position shown in FIG. 10.

As in the first embodiment, once the inside door handle 48 or outside door handle 50 has been pulled by a predetermined amount, a "high" signal is sent to the controller 46. Since the locking mechanism 52 indicates that the latch 8 is unlocked, the controller 46 signals the electric motor 44 to drive and pivot the power release lever 140 in direction X1. The timing of this actuation is controlled to ensure that the clutch lever 30 has already pivoted clockwise. As a result, the power release lever 140 abuts the portion of the second projection 136 extending out of the paper, forcing the pawl lifter 120 and the pawl 116 to rotate counter-clockwise as indicated by arrow Al of FIG. 11. Consequently, the pawl tooth 116*a* disengages from the claw 110, which is now free to rotate counter-clockwise to release the striker and enable the user to open the door.

With the inside door handle 48 and the outside door handle 50 no longer actuated and power actuation ceased, the power release lever 140, the manual release lever 122, and the elongate clutch lever 130 will return to the rest positions shown in FIG. 9. The rest condition unclutches the power actuator drive, and the power release lever 140 cannot block or impede subsequent closing and relatching of the door.

As in the first embodiment, the latch mechanism of this embodiment may also be manually unlatched by pulling further on the inside door handle 48 or the outside door handle 50 as a safety backup system should power unlatching fail.

Figure 10:
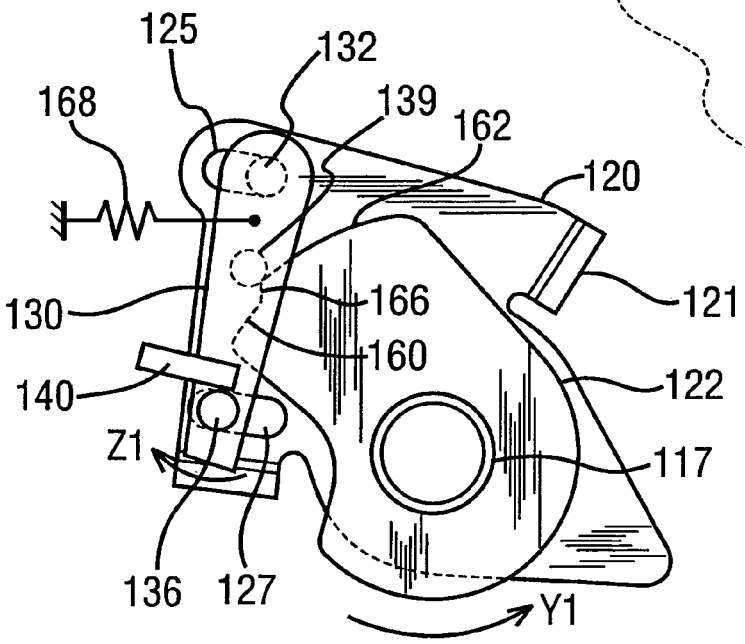
FIG. 10 is a plan view of a the vehicle door latch according to the second embodiment of the present invention in clutch engaged position.
Figure 11:
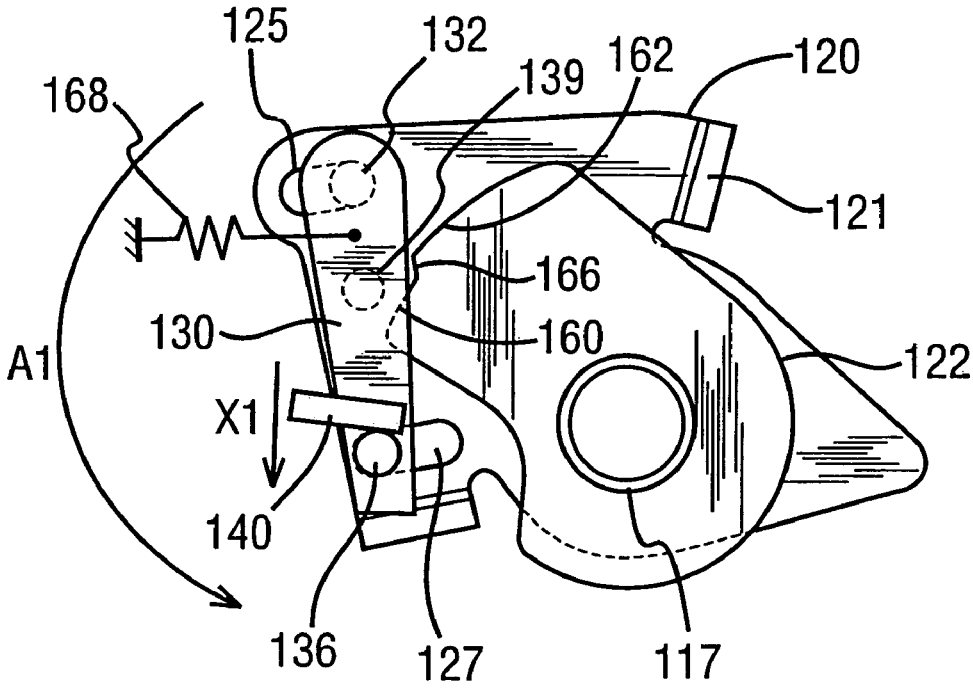
FIG. 11 is a plan view of the vehicle door latch according to the second embodiment of the present invention in a release position.

If the power release lever 140 is actuated, without the inside door handle 48 or the outside door handle 50 having been pulled (e.g., due a short circuit or motor malfunction), the second projection 136 of the clutch lever 30 is not in the clockwise position of FIG. 10 because the cam follower remains on the relatively small constant radius portion 160 of the cam surface. The power release lever 140 therefore does not contact the second projection 136 and moves to the full extent of its travel without causing rotation of the pawl lifter 120.

Figure 12:
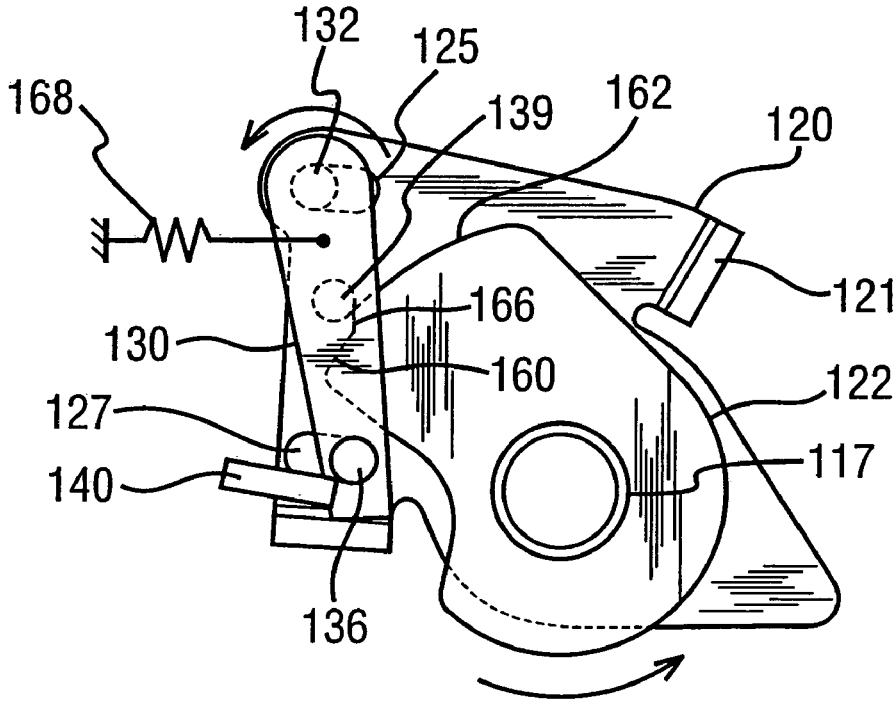
FIG. 12 is a plan view of the vehicle door latch according to the second embodiment of the present invention in a clutch disengaged position.

With reference to FIG. 12, if the power release lever 140 remains in the actuated position (e.g., the power release lever 140 is jammed or permanently actuated) when the inside door handle 48 or the outside door handle 50 are subsequently pulled, the shifting of the cam follower 139 to the relatively large constant radius portion 162 overcomes the resilience of the spring 168 to move the first projection 132 left within the first slot 125 and pivot the elongate clutch lever 130 counter-clockwise about the second projection 136. Rotation of the manual release lever 122, and hence the pawl lifter 120 and the pawl 116, is not blocked and manual release may be achieved.

Both embodiments of the present invention provide a compact and reliable mechanism for ensuring that a power actuator or controller malfunction will not result in release of a latch.

It should be appreciated that various terms as used herein such as "top", "bottom", "left" or "right" to indicate the relative positions of components should not be construed as limiting, and that the latch mechanism of the present invention may be employed in any orientation.

It will be appreciated that numerous changes may be made within the scope of the present invention. For example, the pawl lifter and pawl may be provided as a single component, and any suitable alternative form of mechanism for providing a break in the power unlatching transmission path that is mounted on the pawl lifter may be provided. The mechanism does not necessarily need to be provided with a back-up manual release, and alternative power actuators such as pneumatic motors or solenoids may used in the place of the electric motor.

The foregoing description is only exemplary of the principles of the invention. Many modifications and variations of the present invention are possible in light of the above teachings. The preferred embodiments of this invention have been disclosed, however, so that one of ordinary skill in the art would recognize that certain modifications would come within the scope of this invention. It is, therefore, to be understood that within the scope of the appended claims, the invention may be practiced otherwise than as specifically described. For that reason the following claims should be studied to determine the true scope and content of this invention.

What is claimed is:

1. A latch mechanism for a vehicle door, the latch mechanism comprising:

a latch bolt;

a pawl biased into engagement with the latch bolt to maintain the latch bolt in a latched condition, wherein the pawl has an engaged position where the pawl engages the latch bolt and a disengaged position;

a manual release lever for operable linkage to a vehicle door handle;

a power release member movable to displace the pawl from the engaged position to the disengaged position;

a pawl lifter that shifts the pawl between the engaged position and the disengaged position; and a clutch member mounted to the pawl lifter and being movable by the manual release lever relative to the pawl between a first rest position at which a break is created in a transmission path from the power release member to the pawl and a second position at which power actuation of the power release member is capable of moving the pawl from the engaged position to the disengaged position.

2. The latch mechanism according to claim 1 wherein the clutch member is pivotally mounted.

3. The latch mechanism according to claim 1 further including a power release actuator, wherein the power release member is operatively connected to the power release actuator.

4. The latch mechanism according to claim 1 wherein the power release member is a power release lever.

5. The latch mechanism according to claim 1 wherein the clutch member is resiliently biased into the second position.

6. The latch mechanism according to claim 5 wherein the clutch member is held in the first rest position by the manual release lever when the manual release lever is in a rest position.

7. The latch mechanism according to claim 1 wherein the clutch member is resiliently biased into the first rest position.

8. The latch mechanism according to claim 7 further including a cam and follower arrangement on the manual release lever and the clutch member, wherein the cam and follower arrangement shifts the clutch member between the first rest position and the second position.

9. The latch mechanism according to claim 7 wherein the clutch member is shiftable to a third position to permit the pawl to move to the disengaged position if the power release member obstructs shifting of the clutch member to the second position.

10. The latch mechanism according to claim 9 wherein the clutch member is pivotable about a first pivot point to achieve the second position and the clutch member is pivotable about a second pivot point to achieve the third position.

11. The latch mechanism according to claim 1 further comprising a back-up manual release mechanism.

12. The latch mechanism according to claim 1 wherein the clutch member is biased into the first rest position and is cammed into the second position by operation of the manual release lever.

13. The latch mechanism according to claim 1 wherein the pawl lifter is provided as a single component with the pawl.

14. A latch for a vehicle door comprising:

a latch mechanism including:

a latch bolt, a pawl biased into engagement with the latch bolt to maintain the latch bolt in a latched condition, wherein the pawl has an engaged position where the pawl engages the latch bolt and a disengaged position, a manual release lever for operable linkage to a vehicle door handle, a power release member movable to displace the pawl from the engaged position to the disengaged position, a pawl lifter that shifts the pawl between the engaged position and the disengaged position; and a clutch member mounted to the pawl lifter and being movable by the manual release lever relative to the pawl between a first rest position at which a break is created in a transmission path from the power release member to the pawl and a second position at which power actuation of the power release member is capable of moving the pawl from the engaged position to the disengaged position.

15. The latch according to claim 14 wherein the pawl lifter is provided as a single component with the pawl.

16. A latch mechanism for a vehicle door, the latch mechanism comprising:

a latch bolt;

a pawl biased into engagement with the latch bolt to maintain the latch bolt in a latched condition, wherein the pawl has an engaged position where the pawl engages the latch bolt and a disengaged position;

a manual release lever for operable linkage to a vehicle door handle;

a power release member movable along a path to displace the pawl from the engaged position to the disengaged position;

a pawl lifter that shifts the pawl between the engaged position and the disengaged position; and a clutch member mounted to the pawl lifter and being movable by the manual release lever between a first rest position at which a break is created in a transmission path from the power release member to the pawl and a second position at which power actuation of the power release member is capable of moving the pawl from the engaged position to the disengaged position, wherein the transmission path of the power release member remains the same irrespective of a position of the clutch member.

17. The latch mechanism according to claim 16 wherein the pawl lifter is provided as a single component with the pawl.

* * * * *